US007070900B2

(12) United States Patent
Qian et al.

(10) Patent No.: US 7,070,900 B2
(45) **Date of Patent: *Jul. 4, 2006**

(54) ADJUVANTS FOR POSITIVELY CHARGED TONERS

(75) Inventors: Julie Y. Qian, Woodbury, MN (US); James A. Baker, Hudson, WI (US); Gay L. Herman, Cottage Grove, MN (US)

(73) Assignee: Samsung Electronics Company, Suwon (KR)

( * ) Notice: Subject to any disclaimer, the term of this patent is extended or adjusted under 35 U.S.C. 154(b) by 169 days.

This patent is subject to a terminal disclaimer.

(21) Appl. No.: 10/676,371

(22) Filed: Sep. 30, 2003

(65) Prior Publication Data

US 2005/0069804 A1 Mar. 31, 2005

(51) Int. Cl.
*G03G 9/135* (2006.01)
*G03G 9/13* (2006.01)

(52) U.S. Cl. ..... 430/114; 430/115

(58) Field of Classification Search ..... 430/114, 430/115

See application file for complete search history.

(56) References Cited

U.S. PATENT DOCUMENTS

| | | | | |
|---|---|---|---|---|
| 3,411,936 A | | 11/1968 | Roteman et al. | 117/37 |
| 3,417,019 A | | 12/1968 | Beyer | 252/62.1 |
| 3,681,243 A | * | 8/1972 | Okuno et al. | 430/114 |
| 3,753,760 A | * | 8/1973 | Kosel | 430/119 |
| 3,977,983 A | | 8/1976 | Tsuneda | 430/904 |
| 3,990,980 A | | 11/1976 | Kosel | |
| 4,062,789 A | * | 12/1977 | Tamai et al. | 430/115 |
| 4,273,849 A | | 6/1981 | Merrill et al. | 430/119 |
| 4,547,449 A | | 10/1985 | Alexandrovich et al. | 430/115 |
| 4,707,429 A | | 11/1987 | Trout | 430/115 |
| 4,758,491 A | | 7/1988 | Alexandrovich et al. | 430/110 |
| 4,859,559 A | | 8/1989 | Trout | 430/115 |
| 4,860,924 A | | 8/1989 | Simms et al. | 222/56 |
| 4,886,726 A | | 12/1989 | Chan et al. | 430/115 |
| 4,917,985 A | | 4/1990 | El-Sayed et al. | |
| 4,935,328 A | | 6/1990 | El-Sayed et al. | 430/115 |
| 5,002,848 A | * | 3/1991 | El-Sayed et al. | 430/115 |
| 5,066,821 A | | 11/1991 | Houle et al. | 430/137 |
| 5,223,368 A | | 6/1993 | Ciccarelli et al. | 430/110 |
| 5,254,427 A | | 10/1993 | Lane et al. | 430/137 |
| 5,346,795 A | | 9/1994 | Pickering et al. | 430/110 |

(Continued)

FOREIGN PATENT DOCUMENTS

KR 10-190747 1/1999

(Continued)

OTHER PUBLICATIONS

Diamond, Arthur S & David Weiss (eds.) Handbook of Imaging Materials. New York: Marcel-Dekker, Inc. (Nov. 2001) pp. 242-247, 254, 255.*

(Continued)

*Primary Examiner*—Christopher Rodee
(74) *Attorney, Agent, or Firm*—Kagan Binder, PLLC

(57) ABSTRACT

Positive liquid electrographic toner compositions are provided comprising a liquid carrier having a Kauri-Butanol number less than about 30 mL and a plurality of positively charged toner particles dispersed in the liquid carrier. The toner particles comprise a polymeric binder comprising at least one amphipathic graft copolymer comprising one or more S material portions and one or more D material portions. The toner composition additionally comprises a charge control adjuvant that is an acid or a base. These compositions have surprising bulk conductivity and charge per mass properties, particularly as the toner particles are depleted from the toner composition during printing operations.

20 Claims, 7 Drawing Sheets

*Toner bulk conductivity reduced with the amount of the addition of alkylbenzenesulfonic acid (ABSA, mixture of $C_{11}$, $C_{12}$ and $C_{13}$ carbon chain length) in the depleted toner*

U.S. PATENT DOCUMENTS

| | | | | |
|---|---|---|---|---|
| 5,366,840 | A | 11/1994 | Larson et al. | 430/115 |
| 5,411,834 | A | 5/1995 | Fuller et al. | 430/115 |
| 5,434,030 | A | 7/1995 | Smith et al. | 430/106 |
| 5,529,875 | A | 6/1996 | Russell | 430/137 |
| 5,627,002 | A | 5/1997 | Pan et al. | 430/115 |
| 5,672,456 | A | 9/1997 | Chamberlain et al. | 430/115 |
| 5,679,492 | A | 10/1997 | Chamberlain et al. | 430/115 |
| 5,722,017 | A | 2/1998 | Caruthers, Jr. et al. | 399/238 |
| 5,783,350 | A | 7/1998 | Matsuoka et al. | |
| 6,001,524 | A | 12/1999 | Yoon et al. | 430/106 |
| 6,018,636 | A | 1/2000 | Caruthers | 399/57 |
| 2003/0044202 | A1 | 3/2003 | Song et al. | 399/238 |
| 2004/0091807 | A1* | 5/2004 | Qian et al. | 430/114 |
| 2004/0091808 | A1* | 5/2004 | Qian et al. | 430/114 |
| 2004/0091809 | A1* | 5/2004 | Qian et al. | 430/114 |

FOREIGN PATENT DOCUMENTS

| | | |
|---|---|---|
| KR | 1999-63760 | 7/1999 |
| WO | WO 90/10894 | 3/1990 |

OTHER PUBLICATIONS

Commonly assigned U.S. Appl. No. 10/676,381, filed Sep. 30, 2003, entitled "Adjuvants For Negatively Charged Toners" (48 pgs).

Commonly assigned U.S. Appl. No. 10/677,094, filed Sep. 30, 2003, entitled "Charge Adjuvant Delivery System And Methods" (26 pgs).

E.B. Caruthers,-G.A. Gibson, J.R. Larson and I.D. Morrison, Xerox Corporation, Joseph C. Wilson Center for Technology, Webster, NY "Modeling of Liquid Toner Electrical Characteristics," IST&T's Tenth International Congress on Advances in Non-Impact Printing Technologies (1994), pp. 204-209.

Schmidt, S. P. and Larson, J. R. in Handbook of Imaging Materials Diamond, A. S., Ed: Marcel Dekker: New York; Chapter 6, pp. 227-252.

* cited by examiner

Figure 1, *Effect of critical micelle concentration ("CMC") of alkylbenzenesulfonic acid on toner conductivity.*
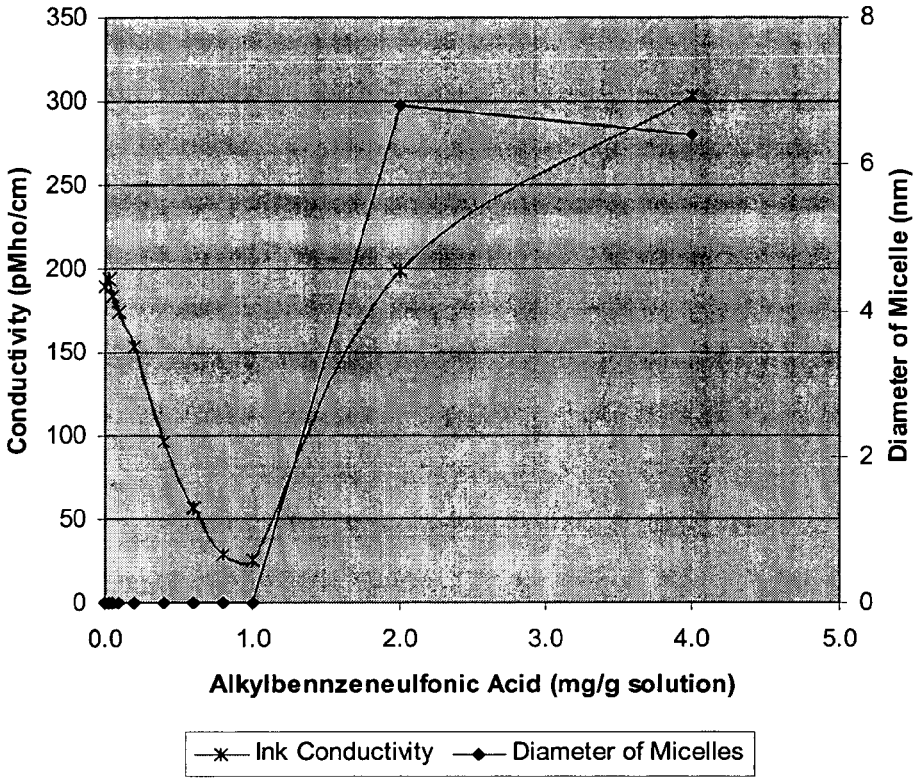

Figure 2, *Toner bulk conductivity reduced with the amount of the addition of alkylbenzenesulfonic acid (ABSA, mixture of $C_{11}$, $C_{12}$ and $C_{13}$ carbon chain length) in the depleted toner*
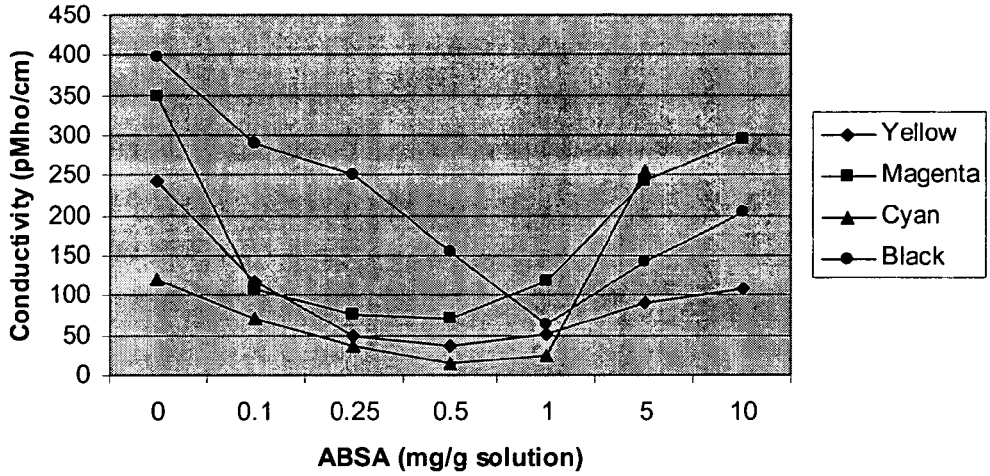

Figure 3, *Toner bulk conductivity decreased with the amount of the addition of dodecylamine (DDA) on depleted toner.*
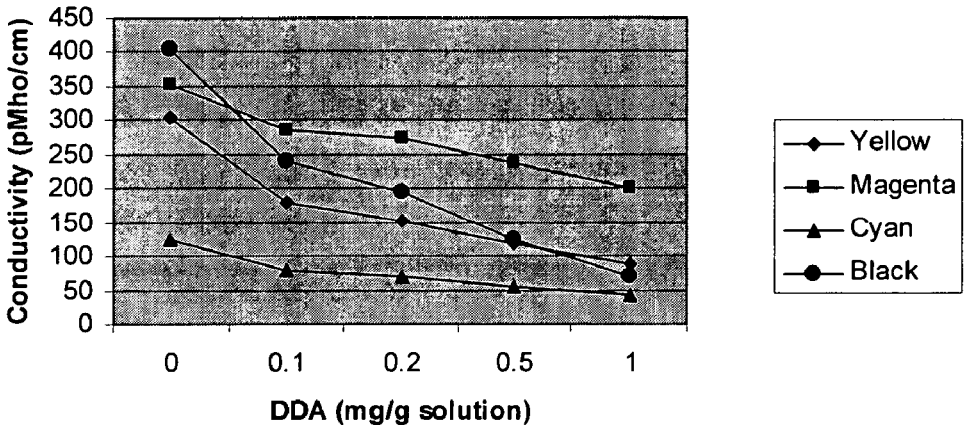

Figure 4, *Effect of carbon chain length of carboxylic acids on bulk conductivity of the black toner.*
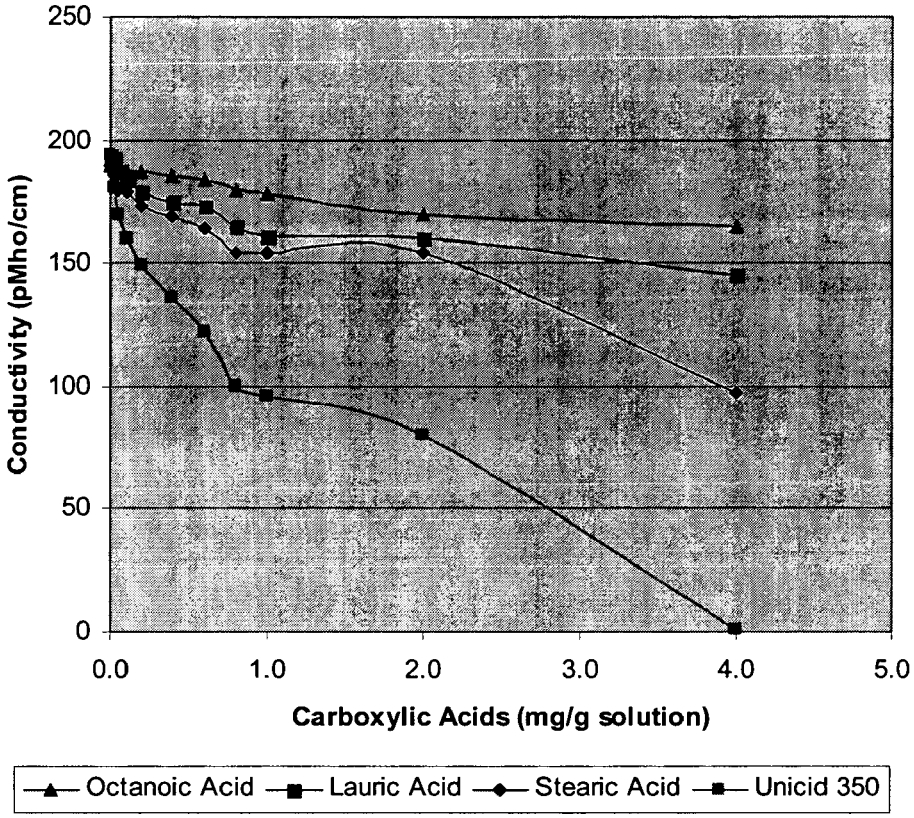

Figure 5, *Effect of carbon chain length of carboxylic acids on Q/M value of the black toner particles.*
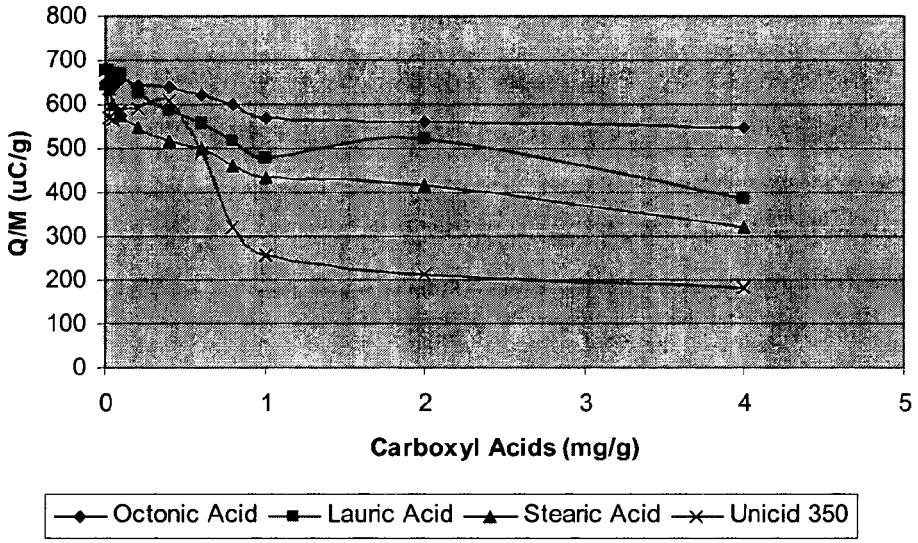

Figure 6, *Effect of carbon chain length of the amines on bulk conductivity of a black toner.*
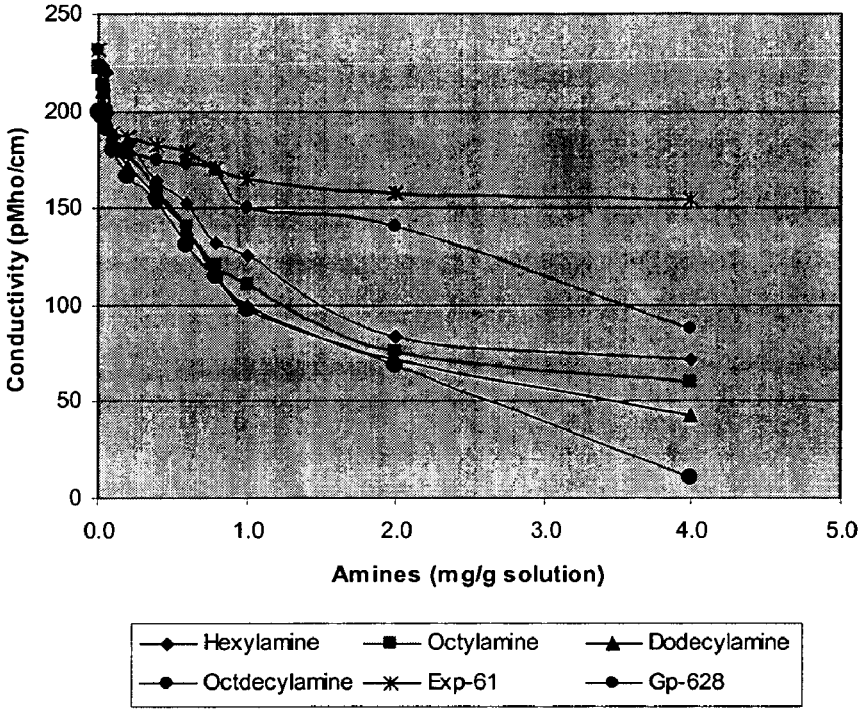

Figure 7, *Effect of carbon chain length of the amines on Q/M value of a black toner particles.*
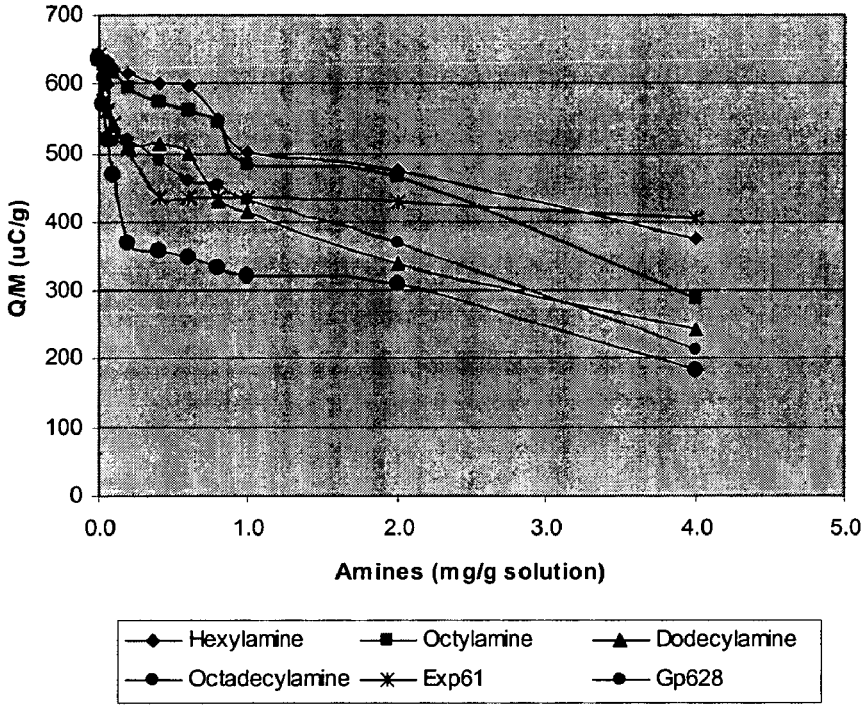

ADJUVANTS FOR POSITIVELY CHARGED TONERS

FIELD OF THE INVENTION

The invention relates to adjuvants for toner compositions. More specifically, the invention relates to adjuvants for liquid toner compositions comprising positively charged toner particles.

BACKGROUND

In electrophotographic and electrostatic printing processes (collectively electrographic processes), an electrostatic image is formed on the surface of a photoreceptive element or dielectric element, respectively. The photoreceptive element or dielectric element may be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227–252, and U.S. Pat. Nos. 4,728,983, 4,321,404, and 4,268,598.

In electrostatic printing, a latent image is typically formed by (1) placing a charge image onto a dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259.

In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like.

Electrophotography typically involves the use of a reusable, light sensitive, temporary image receptor, known as a photoreceptor, in the process of producing an electrophotographic image on a final, permanent image receptor. A representative electrophotographic process, discharged area development, involves a series of steps to produce an image on a receptor, including charging, exposure, development, transfer, fusing, cleaning, and erasure.

In the charging step, a photoreceptor is substantially uniformly covered with charge of a desired polarity to achieve a first potential, either negative or positive, typically with a corona or charging roller. In the exposure step, an optical system, typically a laser scanner or diode array, forms a latent image by selectively discharging the charged surface of the photoreceptor to achieve a second potential in an imagewise manner corresponding to the desired image to be formed on the final image receptor. In the development step, toner particles of the appropriate polarity are generally brought into contact with the latent image on the photoreceptor, typically using a developer electrically-biased to a potential of the same polarity as the toner polarity and intermediate in potential between the first and second potentials. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The image may be transferred by physical pressure and contact of the toner, with selective adhesion to a target intermediate or final image receptor as compared to the surface from which it is transferred. Alternatively, the toner may be transferred in a liquid system optionally using an electrostatic assist as discussed in more detail below. In the fusing step, the toned image on the final image receptor is heated to soften or melt the toner particles, thereby fusing the toned image to the final receptor. An alternative fusing method involves fixing the toner to the final receptor under pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from sub-micron to about 5 microns, liquid toners are capable of producing very high-resolution toned images.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like.

In addition to the polymeric binder and the visual enhancement additive, liquid toner compositions can optionally include other additives. For example, charge directors can be added to impart an electrostatic charge on the toner particles. Dispersing agents can be added to provide colloidal stability, aid fixing of the image, and provide charged or charging sites for the particle surface. Dispersing agents are commonly added to liquid toner compositions because toner particle concentrations are high (inter-particle distances are small) and electrical double-layer effects alone will not adequately stabilize the dispersion with respect to aggregation or agglomeration. Release agents can also be used to help prevent the toner from sticking to fuser rolls when those are used. Other additives include antioxidants, ultraviolet stabilizers, fungicides, bactericides, flow control agents, and the like.

U.S. Pat. No. 4,547,449 to Alexandrovich, et al. discloses liquid electrographic developers comprising an electrically insulating liquid carrier, toner, a charge-control agent and a charging agent. The charge-control agent is a carrier-soluble, addition copolymer of a quaternary ammonium salt monomer, a monomer having —COOH, —$SO_3H$ or —$PO_3HR$ acidic function wherein R is hydrogen or alkyl, and a solubilizing monomer. The charging agent is a carrier-soluble, addition polar copolymer. The disclosed developers are stated to exhibit improved replenishability as evidenced by reduced buildup of charge in the developers during the course of use and repeated replenishment. Specifically, this patent noted that the prior art exhibited drawbacks relating to the stability of their charge as they are used through a number of copy sequences. In particular, the charge of the developer per unit of mass of dispersed toner of the prior art increases, indicating that the quaternary ammonium charge-control copolymer deposits on an electrostatic image at a lower rate than the toner. This uneven depletion rate and consequential increase in charge per unit mass in the developer presents difficulty in developer replenishment and causes nonuniform image density from copy to copy. The invention as described therein is asserted to stabilize the charge of the developer per unit mass of toner is so that, after a period of use, the buildup of charge per unit of mass is significantly reduced. Such stability is stated to be achieved when the quaternary ammonium salt charge-control polymer in the developer composition contains an insolubilizing monomer having an acidic function selected from the group consisting of —COOH, —$SO_3H$ or —$PO_3HR$ acidic function wherein R is hydrogen or alkyl.

Charge directors, including certain quaternary ammonium salts, are disclosed in Beyer, U.S. Pat. No. 3,417,019 and Tsuneda, U.S. Pat. No. 3,977,983 for liquid developers.

U.S. Pat. No. 5,627,002 to Pan, et al. discloses a positively charged liquid developer comprised of a nonpolar liquid, thermoplastic resin particles, pigment, a charge control agent, and a charge director comprised of a cyclodextrin or a cyclodextrin derivative containing one or more organic basic amino groups. This patent states that the hollow interiors provide these cyclic molecules with the ability to complex and contain, or trap a number of molecules or ions, such as positively charged ions like benzene ring containing hydrophobic cations, which are known to insert themselves into the cyclodextrin cavities.

U.S. Pat. No. 5,411,834 to Fuller discloses a negatively charged liquid developer comprised of thermoplastic resin particles, optional pigment, a charge director, and an insoluble charge adjuvant comprised of a copolymer of an alkene and an unsaturated acid derivative. The acid derivative contains pendant fluoroalkyl or pendant fluoroaryl groups, and the charge adjuvant is associated with or combined with said resin and said optional pigment. In certain embodiments, it is stated that "it is important that the thermoplastic resin, copolymers with pendant fluorinated groups as illustrated herein, and the optional second charge adjuvant be sufficiently compatible that they do not form separate particles, and that the charge adjuvant be insoluble in the hydrocarbon to the extent that no more than 0.1 weight percent be soluble in the nonpolar liquid." See column 8, lines 44–50.

U.S. Pat. No. 6,018,636 to Caruthers discloses an imaging system wherein changes in toner developability of toners in a liquid toner system are determined and compensated for by sensing the toner concentration and liquid toner volume in a tank, based on changes in the toner concentration and toner mass in the tank. Based on measurements made of the toner and/or a test printed image, adjustments can be made, such as creating a new voltage differential or adding toner and/or liquid carrier material to the tank.

U.S. Pat. No.5,722,017 to Caruthers discloses a liquid developing material replenishment system wherein an apparatus for developing an electrostatic latent image with a liquid developing material includes a liquid developing reservoir for providing a supply of operative liquid developing material to the developing apparatus, and a liquid developing material supply is coupled to the liquid developing material reservoir for providing a supply of liquid developing concentrate to the liquid developing material reservoir for replenishing the supply of operative liquid developing material in the liquid developing reservoir. A developed image having a large proportion of printed image area or having substantially a single color will cause a greater depletion of marking particles and/or charge director in the liquid developing material supply tank as compared to a developed image with a small amount of printed image area or of a single color. This patent explains that > while the rate of the replenishment of the liquid developing material may be controlled by simply monitoring the level of liquid developer in the supply reservoir 116, in advanced systems the rate of replenishment of the liquid carrier, the marking particles, and/or the charge director components of the liquid developing material is controlled in a more sophisticated manner to maintain a predetermined concentration of the marking particles and the charge director in the operative solution stored in the supply reservoir 116. One exemplary replenishment systems of this nature include systems which measure the conductivity of the operative liquid developing material and add selective amounts of charge director compound to the reservoir as a function of the measured a conductivity, as disclosed in detail in U.S. Pat. No. 4,860,924, incorporated by reference herein. Another system of this nature is disclosed in commonly assigned U.S. patent application Ser. No. 08/551,381, also incorporated by reference herein, which describes control of the amount of carrier liquid, charge director and/or marking particles in a liquid developing material reservoir in response to the amount of each component depleted therefrom as a function of the number of pixels making up each developed image.

See column 14, line 48 to column 15, line 3.

U.S. Pat. No. 4,860,924 to Simms, et. al. discloses a copier wherein charge director is supplied to a liquid developer in response to a conductivity measurement thereof. Toner concentrate deficient in charge director is supplied to the liquid developer in response to an optical transmissivity measurement thereof. Conductivity is measured by a pair of spaced electrodes immersed in the developer and through which a variable alternating current is passed. A variable capacitor neutralizes the inherent capacitance of the electrodes. A phase sensitive detector is provided with a reference voltage having the same phase shift as that caused by capacitive effects. The conductivity measurement is corrected in response to a developer temperature measurement.

U.S. Pat. No. 4,935,328 to El-Sayed discloses an electrostatic liquid developer stated to have improved negative charging characteristics consisting essentially of (A) nonpolar liquid having a Kauri-butanol value of less than 30, present in a major amount, (B) thermoplastic resin particles having an average by area particle size of less than 10 μm, (C) charge director compound, and (D) at least one soluble solid or liquid organic monofunctional amine compound of the formula: $R_n$ $NH_{3-n}$ wherein R is alkyl, cycloalkyl or alkylene, or substituted alkyl, the alkyl, cycloalkyl, alkylene or substituted alkyl group being of 1 to 50 carbon atoms, and n is an integer of 1 to 3. The electrostatic liquid developer is useful in copying, making proofs including digital color proofs, lithographic printing plates, and resists.

SUMMARY OF THE INVENTION

The conductivity of a conventional liquid toner usually increases with the number of prints, and thus decreases optical density of the images. Usually after 2000 to 3000 prints, the toner conductivities will become too high to produce a good image. It has surprisingly been found that addition of an acidic or basic charge adjuvant to a positive liquid electrographic toner compositions comprising an amphipathic graft copolymer containing binder can prevent this increase of the toner conductivity during printing, and maintain a desirable optical density of the image throughout the life time of a toner cartridge.

The present invention relates to positive liquid electrographic toner compositions comprising a liquid carrier having a Kauri-Butanol number less than about 30 mL, a plurality of positively charged toner particles dispersed in the liquid carrier, wherein the toner particles comprise a polymeric binder comprising at least one amphipathic graft copolymer comprising one or more S material portions and one or more D material portions; and an acidic or basic charge control adjuvant.

Preferably, the charge control adjuvant is selected from the group consisting of alkyl amines and alkyl acids. As used herein, the term "amphipathic" refers to a graft copolymer having a combination of portions having distinct solubility and dispersibility characteristics in a desired liquid carrier that is used to make the copolymer and/or used in the course of preparing the liquid toner particles. Preferably, the liquid carrier (also sometimes referred to as "carrier liquid") is selected such that at least one portion (also referred to herein as S material or block(s)) of the copolymer is more solvated by the carrier while at least one other portion (also referred to herein as D material or block(s)) of the copolymer constitutes more of a dispersed phase in the carrier.

BRIEF DESCRIPTION OF THE DRAWINGS

FIG. 1 is a chart showing toner bulk conductivity as a function of the amount of acid charge control adjuvant and micelle diameter of adjuvant in a toner composition.

FIG. 2 is a chart showing toner bulk conductivity as a function of the amount of acid charge control adjuvant in additional toner compositions.

FIG. 3 is a chart showing toner bulk conductivity as a function of the amount of a base charge control adjuvant in a toner composition.

FIG. 4 is a chart showing toner bulk conductivity as a function of the carbon chain length and amount of acid charge control adjuvants in a toner composition.

FIG. 5 is a chart showing charge per unit mass as a function of the carbon chain length and amount of acid charge control adjuvants in a toner composition.

FIG. 6 is a chart showing toner bulk conductivity as a function of the carbon chain length and amount of base charge control adjuvants in a toner composition.

FIG. 7 is a chart showing charge per unit mass as a function of the carbon chain length and amount of base charge control adjuvants in a toner composition.

DETAILED DESCRIPTION

Toner particles comprising amphipathic copolymers are stably dispersed in liquid toners, and generally do not require addition of surfactants or other such modifiers in the toner composition. The addition of acid or base components to positively charged toner particles as described herein provide exceptional charge control benefits. While not being bound by theory, it is believed that the adjuvant as described herein selectively coordinates with counterions in the toner composition, possibly including counterions previously associated with charge directors associated with the toner particles. Surprisingly, the charge control adjuvant reduces the bulk conductivity of the liquid toner composition and preferably simultaneously reduces the charge per mass of the toner particles. This charge effect, both in bulk conductivity and charge per mass is of particular benefit during printing operations, providing an excellent charge balance in the toner system even as toner concentrations change as toner is depleted.

The charge control adjuvant may be a monomeric, oligomeric, or polymeric material, provided that it comprises sufficient acid or base functionality to exhibit the desired charge control attributes as described herein. Preferably, the charge control adjuvant is present in the liquid carrier in an amount higher than the solubility of the charge control adjuvant in the liquid carrier, or in other words, there is insolubilized charge control adjuvant present in the system. Preferably, the charge control agent has a solubility of from about 0.1 to about 10 mg/g in the liquid carrier. Surprisingly, the charge control adjuvant need have very little solubility in the liquid carrier to provide excellent charge control properties as described herein. In particular, polymeric charge control adjuvants that are sparingly soluble are surprisingly effective in providing the desired charge control properties. Thus, it has surprisingly been found that a polymeric article as described herein may be placed in contact with the liquid carrier of the toner composition at some point in the printing process, with the result of charge control benefits being observed. In one aspect of the present invention, a structure that a toner composition contacts may be formed from a polymeric charge control adjuvant, with the result of charge control benefits being observed.

When the charge control adjuvant is a base, it is preferably selected from amines. The amine functionalities may be primary, secondary or tertiary amines. In one embodiment of the present invention, the charge control adjuvant may be an amine functional polymer, such as a silicone polymer having amine functionalities (e.g. aminoalkyl pendant functionalities), or may be a carbon based polymer having amine functionalities (e.g. acrylate, polyester, epoxy or polyether polymer comprising amine functionalities). An example of such a polymer is GP530, commercially available from Genesee Polymers, Flint, Mich. In another embodiment of the present invention, the charge control adjuvant may be a hydroxyl functional polymer, such as Joncryl™ polymers designated with the numbers SCX-804 or 578 from S.C. Johnson Polymers, Racine, Wis.

In a preferred embodiment of the present invention, the charge control adjuvant is selected from the group consisting of alkyl amines, and most preferably alkyl amines having 6 to 60 carbon atoms in the alkyl portions of the alkyl group of the alkyl amine. In a particularly preferred embodiment, the charge control adjuvant is one or more alkyl amines having 12 to 18 carbon atoms in the alkyl portions of the alkyl group of the alkyl amine. Examples of specifically preferred charge control adjuvants include hexylamine, octylamine, dodecylamine, tetradecylamine, hexadecylamine, octadecylamine and mixtures thereof.

When the charge control adjuvant is an acid, it is preferably selected from carboxylic and sulfonic acids. In one embodiment of the present invention, the charge control adjuvant may be an acid functional polymer, such as a silicone polymer having acid functionalities or may be a carbon based polymer having acid functionalities (e.g. acrylate, polyester, epoxy or polyether polymer comprising acid functionalities). Examples of such polymers include styrene acrylic resins having carboxyl functionality, such as 'ALMACRYL B-1504" from Image Polymers Co., Wilmington, Mass., and Joncryl™ polymers designated with the numbers 67, 586, 611, 678, 690, SCX-815, SCX-817, SCX-819, SCX-835 and SCX-839 from S.C. Johnson Polymers, Racine, Wis. Further examples include ethylene vinyl acetate acid terpolymers such as ELVAX polymer designated 4260, 4310, 4320 and 4355.

In a preferred embodiment of the present invention, the charge control adjuvant is selected from the group consisting of alkyl acids, and most preferably alkyl acids having 6 to 60 carbon atoms in the alkyl portions of the alkyl group of the alkyl acid. In a particularly preferred embodiment, the charge control adjuvant is one or more alkyl acids having 12 to 18 carbon atoms in the alkyl portions of the alkyl group of the alkyl acid. Preferably the acid is an alkyl benzene sulfonic acid or an alkyl carboxylic acid. Examples of specifically preferred charge control adjuvants include hexanoic acid, octanoic acid, dodecanoic acid, tetradecanoic acid, hexadecanoic acid, octadecanoic acid, hexyl benzene sulfonic acid, octyl benzene sulfonic acid, dodecyl benzene sulfonic acid, tetradecyl benzene sulfonic acid, hexadecyl benzene sulfonic acid, octadecyl benzene sulfonic acid and mixtures thereof. In a preferred embodiment, the charge control adjuvant is ABSA, an alkyl benzene sulfonic acid that comprises a blend of C11, C12 and C13 carbon chain length alkyl portions.

Preferably, the charge control adjuvant is present in the toner composition at a concentration of from about 0.5 mg/g to about 5 mg/g in the liquid carrier.

Preferably, the acid or base charge control adjuvant exhibits limited solubility in the liquid carrier of the toner composition, so that the charge control adjuvant can be provided in excess to the toner composition without all of the charge control adjuvant going into solution. In this embodiment, as images are printed from the toner composition, toner particles are depleted and the charge of the composition changes. Additional charge control adjuvant is present in contact with the toner composition before or during the printing process, and available for solvation. The passive addition of charge control adjuvant provides a proper balance of charge in the system, thereby further benefiting printing operations. The charge control adjuvant may be provided at desired locations or configurations in the toner cartridge for convenient dispensing as will now be appreciated by the skilled artisan. Specific configurations are as described in commonly assigned U.S. patent application Ser. No. 10/677,094 entitled "CHARGE ADJUVANT DELIVERY SYSTEM AND METHODS," filed on even date herewith and incorporated by reference herein. Preferably, the charge control adjuvant has a solubility of from about 0.1 mg/g to about 10 mg/g in the liquid carrier.

In a particularly preferred embodiment, the charge control adjuvant is capable of forming micelles in the liquid carrier. Most preferably, the charge control adjuvant is the present in the composition in the form of micelles having a size range of from about 5 to about 50 nm.

The toner comprises an amphipathic graft copolymer that has been dispersed in a liquid carrier to form an organosol, then mixed with other ingredients to form a liquid toner composition. Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D.H., "Polymeric Stabilization of Colloidal Dispersions," Academic Press, New York, N.Y., 1983. Procedures for synthesizing self-stable organosols are described in "Dispersion Polymerization in Organic Media," K.E.J. Barrett, ed., John Wiley: New York, N.Y., 1975.

Once the organosol has been formed, one or more additives can be incorporated, as desired. For example, one or more visual enhancement additives or charge directors can be incorporated. The composition can then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated visual enhancement additive particles, when present, into primary particles (having a diameter in the range of 0.05 to 5 microns) and may also partially shred the dispersed copolymeric binder into fragments that can associate with the surface of the visual enhancement additive.

According to this embodiment, the dispersed copolymer or fragments derived from the copolymer then associate with the visual enhancement additive, for example, by adsorbing to or adhering to the surface of the visual enhancement additive, thereby forming toner particles. The result is a sterically-stabilized, nonaqueous dispersion of toner particles having a volume mean particle diameter (determined with laser diffraction) in the range of about 0.05 to about 50 microns, more preferably in the range of about 3 to about 10 microns, most preferably in the range of about 1.5 to about 5 microns. In some embodiments, one or more charge directors can be added before or after mixing, if desired.

Preferably, the nonaqueous liquid carrier of the organosol is selected such that at least one portion (also referred to herein as the S material or portion) of the amphipathic copolymer is more solvated by the carrier while at least one other portion (also referred to herein as the D material or portion) of the copolymer constitutes more of a dispersed phase in the carrier. In other words, preferred copolymers of the present invention comprise S and D material having respective solubilities in the desired liquid carrier that are sufficiently different from each other such that the S blocks tend to be more solvated by the carrier while the D blocks tend to be more dispersed in the carrier. More preferably, the S blocks are soluble in the liquid carrier while the D blocks are insoluble. In particularly preferred embodiments, the D material phase separates from the liquid carrier, forming dispersed particles.

From one perspective, the polymer particles when dispersed in the liquid carrier may be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material may also be referred to herein as a "graft stabilizer." The core/shell structure of the binder particles tends to be retained when the particles are dried when incorporated into liquid toner particles.

The solubility of a material, or a portion of a material such as a copolymeric portion, may be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H\text{-}RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters,* 2d Ed. CRC Press, Boca Raton, Fla., (1991), for monomers and representative polymers in *Polymer Handbook,* 3rd Ed., J. Brandrup & E. H. Immergut, Eds. John Wiley, N.Y., pp 519–557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a liquid carrier may be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the liquid carrier, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the liquid carrier.

Consequently, in preferred embodiments, the absolute difference between the respective Hildebrand solubility parameters of the S portion(s) of the copolymer and the liquid carrier is less than 3.0 $MPa^{1/2}$, preferably less than about 2.0 $MPa^{1/2}$, more preferably less than about 1.5 $MPa^{1/2}$. Additionally, it is also preferred that the absolute difference between the respective Hildebrand solubility parameters of the D portion(s) of the copolymer and the liquid carrier is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D portion(s) is at least about 0.4 $MPa^{1/2}$, more preferably at least about 1.0 $MPa^{1/2}$. Because the Hildebrand solubility of a material may vary with changes in temperature, such solubility parameters are preferably determined at a desired reference temperature such as at 25° C.

Those skilled in the art understand that the Hildebrand solubility parameter for a copolymer, or portion thereof, may be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446–448. Thus, there will be a preferred molecular weight range for a given polymer or portion thereof in order to achieve desired solvating or dispersing characteristics. Similarly, the Hildebrand solubility parameter for a mixture may be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrophotographic toner and the Hildebrand solubility parameters and glass transition temperatures (based on their high molecular weight homopolymers) for some common monomers used in synthesizing organosols.

TABLE I

Hildebrand Solubility Parameters
Solvent Values at 25° C.

| Solvent Name | Kauri-Butanol Number by ASTM Method D1133-54T (ml) | Hildebrand Solubility Parameter ($MPa^{1/2}$) |
|---|---|---|
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

Monomer Values at 25° C.

| Monomer Name | Hildebrand Solubility Parameter ($MPa^{1/2}$) | Glass Transition Temperature (° C.)* |
|---|---|---|
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (45 m.p.)** |
| n-Octadecyl Acrylate | 16.82 | −55 |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |

TABLE I-continued

| | | |
|---|---|---|
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Calculated using Small's Group Contribution Method, Small, P. A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209–277 (1989). The $T_g$ listed is for the homopolymer of the respective monomer.
**m.p. refers to melting point for selected Polymerizable Crystallizable Compounds.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water. The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, N.J.), and most preferred carriers are the aliphatic hydrocarbon solvent blends such as Norpar™ 12, Norpar™ 13 and Norpar™15 (available from Exxon Corporation, N.J.). Particularly preferred carrier liquids have a Hildebrand solubility parameter of from about 13 to about 15 $MPa^{1/2}$.

The liquid carrier of the toner compositions of the present invention is preferably the same liquid as used as the solvent for preparation of the amphipathic copolymer. Alternatively, the polymerization may be carried out in any appropriate solvent, and a solvent exchange may be carried out to provide the desired liquid carrier for the toner composition.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

The term "macromer" or "macromonomer" refers to an oligomer or polymer having a terminal polymerizable moiety. "Polymerizable crystallizable compound" or "PCC" refers to compounds capable of undergoing polymerization to produce a copolymer wherein at least a portion of the copolymer is capable of undergoing reversible crystallization over a reproducible and well-defined temperature range (e.g. the copolymer exhibits a melting and freezing point as determined, for example, by differential scanning calorimetry). PCC's may include monomers, functional oligomers, functional pre-polymers, macromers or other compounds able to undergo polymerization to form a copolymer. The term "molecular weight" as used throughout this specification means weight average molecular weight unless expressly noted otherwise.

The weight average molecular weight of the amphipathic copolymer of the present invention may vary over a wide range, and may impact imaging performance. The polydispersity of the copolymer also may impact imaging and transfer performance of the resultant liquid toner material. Because of the difficulty of measuring molecular weight for an amphipathic copolymer, the particle size of the dispersed copolymer (organosol) may instead be correlated to imaging and transfer performance of the resultant liquid toner material. Generally, the volume mean particle diameter ($D_v$) of the dispersed graft copolymer particles, determined by laser diffraction particle size measurement, should be in the range 0.1–100 microns, more preferably 0.5–50 microns, even more preferably 1.0–20 microns, and most preferably 2–10 microns.

In addition, a correlation exists between the molecular weight of the solvatable or soluble S portion of the graft copolymer, and the imaging and transfer performance of the resultant toner. Generally, the S portion of the copolymer has a weight average molecular weight in the range of 1000 to about 1,000,000 Daltons, preferably 5000 to 400,000 Daltons, more preferably 50,000 to 300,000 Daltons. It is also generally desirable to maintain the polydispersity (the ratio of the weight-average molecular weight to the number average molecular weight) of the S portion of the copolymer below 15, more preferably below 5, most preferably below 2.5. It is a distinct advantage of the present invention that copolymer particles with such lower polydispersity characteristics for the S portion are easily made in accordance with the practices described herein, particularly those embodiments in which the copolymer is formed in the liquid carrier in situ.

The relative amounts of S and D portions in a copolymer can impact the solvating and dispersibility characteristics of these portions. For instance, if too little of the S portion(s) are present, the copolymer may have too little stabilizing effect to sterically-stabilize the organosol with respect to aggregation as might be desired. If too little of the D portion(s) are present, the small amount of D material may be too soluble in the liquid carrier such that there may be insufficient driving force to form a distinct particulate, dispersed phase in the liquid carrier. The presence of both a solvated and dispersed phase helps the ingredients of particles self assemble in situ with exceptional uniformity among separate particles. Balancing these concerns, the preferred weight ratio of D material to S material is in the range of 1:20 to 20:1, preferably 1:1 to 15:1, more preferably 2:1 to 10:1, and most preferably 4:1 to 8:1.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1 T_{g1} + w_2/T_{g2} + \ldots w_i T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, N.Y., pp 54–55 (1992).

In the practice of the present invention, values of $T_g$ for the D or S portion of the copolymer were determined using the Fox equation above, although the $T_g$ of the copolymer as a whole may be determined experimentally using e.g. differential scanning calorimetry. The glass transition temperatures ($T_g$'s) of the S and D portions may vary over a wide range and may be independently selected to enhance manufacturability and/or performance of the resulting liquid toner particles. The $T_g$'s of the S and D portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

For copolymers useful in liquid toner applications, the copolymer $T_g$ preferably should not be too low or else receptors printed with the toner may experience undue blocking. Conversely, the minimum fusing temperature required to soften or melt the toner particles sufficient for them to adhere to the final image receptor will increase as the copolymer $T_g$ increases. Consequently, it is preferred that the $T_g$ of the copolymer be far enough above the expected maximum storage temperature of a printed receptor so as to avoid blocking issues, yet not so high as to require fusing temperatures approaching the temperatures at which the final image receptor may be damaged, e.g. approaching the autoignition temperature of paper used as the final image receptor. In certain preferred embodiments of the present invention, the copolymer of the toner particle preferably has a $T_g$ that is greater than about 30° C., and preferably from about 30 to about 125° C. Toners exhibiting this $T_g$ are particularly preferred in electrographic printing processes, where a soft copolymer may be detrimental to image transfer. In other preferred embodiments of the present invention, the copolymer of the toner particle preferably has a $T_g$ that is less than about 30° C., and preferably from about −25 to about 25° C. Toners exhibiting this Tg are particularly preferred in alternative printing processes, where a soft copolymer is desired for self-fixing properties and other properties advantageous for that particular process.

Incorporation of a polymerizable crystallizable compound (PCC) in the copolymer will generally permit use of a lower copolymer $T_g$ and therefore lower fusing temperatures without the risk of the image blocking at storage temperatures below the melting temperature of the PCC.

In one aspect of the present invention, desirably, the copolymer has a $T_g$ of 25°–100° C., more preferably 30°–80° C., most preferably 40°–70° C.

For copolymers in which the D portion comprises a major portion of the copolymer, the $T_g$ of the D portion will dominate the $T_g$ of the copolymer as a whole. For such copolymers useful in liquid toner applications, it is preferred that the $T_g$ of the D portion fall in the range of 30°–105° C., more preferably 40°–95° C., most preferably 50°–85° C., since the S portion will generally exhibit a lower $T_g$ than the D portion, and a higher $T_g$ D portion is therefore desirable to offset the $T_g$ lowering effect of the S portion, which may be solvatable. In this regard, incorporation of a polymerizable crystallizable compound (PCC) in the D portion of the copolymer will generally permit use of a lower D portion $T_g$ and therefore lower fusing temperatures without the risk of the image blocking at storage temperatures below the melting temperature of the PCC.

Blocking with respect to the S portion material is not as significant an issue inasmuch as preferred copolymers comprise a majority of the D portion material. Consequently, the $T_g$ of the D portion material will dominate the effective $T_g$ of the copolymer as a whole. However, if the $T_g$ of the S portion is too low, then the particles might tend to aggregate. On the other hand, if the $T_g$ is too high, then the requisite fusing temperature may be too high. Balancing these concerns, the S portion material is preferably formulated to have a $T_g$ of at least 0° C., preferably at least 20° C., more preferably at least 40° C. In this regard, incorporation of a polymerizable crystallizable compound (PCC) in the S portion of the copolymer will generally permit use of a lower S portion $T_g$. It is understood that the requirements imposed on the self-fixing characteristics of a liquid toner will depend to a great extent upon the nature of the imaging process. For example, rapid self-fixing of the toner to form a cohesive film may not be required or even desired in an electrographic imaging process if the image is not subsequently transferred to a final receptor, or if the transfer is effected by means (e.g. electrostatic transfer) not requiring a film formed toner on a temporary image receptor (e.g. a photoreceptor).

Preferred copolymers of the present invention may be formulated with one or more radiation curable monomers or combinations thereof that help the free radically polymerizable compositions and/or resultant cured compositions to satisfy one or more desirable performance criteria. For example, in order to promote hardness and abrasion resistance, a formulator may incorporate one or more free radically polymerizable monomer(s) (hereinafter "high $T_g$ component") whose presence causes the polymerized material, or a portion thereof, to have a higher glass transition temperature, $T_g$, as compared to an otherwise identical material lacking such high $T_g$ component. Preferred monomeric constituents of the high $T_g$ component generally include monomers whose homopolymers have a $T_g$ of at least about 50° C., preferably at least about 60° C., and more preferably at least about 75° C. in the cured state, provided in a combination so that the D component of the copolymer has a minimum Tg as discussed herein.

An exemplary class of radiation curable monomers that tend to have relatively high $T_g$ characteristics suitable for incorporation into the high $T_g$ component generally comprise at least one radiation curable (meth)acrylate moiety and at least one nonaromatic, alicyclic and/or nonaromatic heterocyclic moiety. Isobornyl (meth)acrylate is a specific example of one such monomer. A cured, homopolymer film formed from isobornyl acrylate, for instance, has a $T_g$ of 110° C. The monomer itself has a molecular weight of 222 g/mole, exists as a clear liquid at room temperature, has a viscosity of 9 centipoise at 25° C., and has a surface tension of 31.7 dynes/cm at 25° C. Additionally, 1,6-Hexanediol di(meth)acrylate is another example of a monomer with high $T_g$ characteristics.

Particularly preferred monomers for use in the D portion of the amphipathic copolymer include trimethyl cyclohexyl methacrylate; ethyl methacrylate; ethyl acrylate; isobornyl (meth)acrylate; 1,6-Hexanediol di(meth)acrylate and methyl methacrylate. Particularly preferred monomers for use in the S portion of the amphipathic copolymer include lauryl methacrylate, 2-hydroxyethyl methacrylate, dimethyl-m-isopropenyl benzyl isocyanate, trimethyl cyclohexyl methacrylate, and ethyl hexyl methacrylate.

A wide variety of one or more different monomeric, oligomeric and/or polymeric materials may be independently incorporated into the S and D portions, as desired. Representative examples of suitable materials include free radically polymerized material (also referred to as vinyl copolymers or (meth) acrylic copolymers in some embodiments), polyurethanes, polyester, epoxy, polyamide, polyimide, polysiloxane, fluoropolymer, polysulfone, combinations of these, and the like. Preferred S and D portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case may be) that participate in polymerization reactions via a free radical mechanism. Representative examples of such functionality includes (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth)acryl", as used herein, encompasses acryl and/or methacryl.

Free radically polymerizable monomers, oligomers, and/or polymers are advantageously used to form the copolymer in that so many different types are commercially available and may be selected with a wide variety of desired characteristics that help provide one or more desired performance characteristics. Free radically polymerizable monomers, oligomers, and/or monomers suitable in the practice of the present invention may include one or more free radically polymerizable moieties.

Representative examples of monofunctional, free radically polymerizable monomers include styrene, alpha-methylstyrene, substituted styrene, vinyl esters, vinyl ethers, N-vinyl-2-pyrrolidone, (meth)acrylamide, vinyl naphthalene, alkylated vinyl naphthalenes, alkoxy vinyl naphthalenes, N-substituted (meth)acrylamide, octyl (meth)acrylate, nonylphenol ethoxylate (meth)acrylate, N-vinyl pyrrolidone, isononyl (meth)acrylate, isobornyl (meth)acrylate, 2-(2-ethoxyethoxy)ethyl (meth)acrylate, 2-ethylhexyl (meth)acrylate, beta-carboxyethyl(meth)acrylate, isobutyl (meth)acrylate, cycloaliphatic epoxide, alpha-epoxide, 2-hydroxyethyl (meth)acrylate, (meth)acrylonitrile, maleic anhydride, itaconic acid, isodecyl (meth)acrylate, lauryl (dodecyl) (meth)acrylate, stearyl (octadecyl) (meth)acrylate, behenyl (meth)acrylate, n-butyl (meth)acrylate, methyl (meth)acrylate, ethyl (meth)acrylate, hexyl (meth)acrylate, (meth)acrylic acid, N-vinylcaprolactam, stearyl (meth)acrylate, hydroxy functional caprolactone ester (meth)acrylate, isooctyl (meth)acrylate, hydroxyethyl (meth)acrylate, hydroxymethyl (meth)acrylate, hydroxypropyl (meth)acrylate, hydroxyisopropyl (meth)acrylate, hydroxybutyl (meth) acrylate, hydroxyisobutyl (meth)acrylate, tetrahydrofurfuryl (meth)acrylate, isobornyl (meth)acrylate, glycidyl (meth) acrylate vinyl acetate, combinations of these, and the like.

Nitrile functionality may be advantageously incorporated into the copolymer for a variety of reasons, including improved durability, enhanced compatibility with visual enhancement additive(s), e.g., colorant particles, and the like. In order to provide a copolymer having pendant nitrile groups, one or more nitrile functional monomers can be used. Representative examples of such monomers include (meth)acrylonitrile, β-cyanoethyl-(meth)acrylate, 2-cyanoethoxyethyl (meth)acrylate, p-cyanostyrene, p-(cyanomethyl)styrene, N-vinylpyrrolidinone, and the like.

In order to provide a copolymer having pendant hydroxyl groups, one or more hydroxyl functional monomers can be used. Pendant hydroxyl groups of the copolymer not only facilitate dispersion and interaction with the pigments in the formulation, but also promote solubility, cure, reactivity with other reactants, and compatibility with other reactants. The hydroxyl groups can be primary, secondary, or tertiary, although primary and secondary hydroxyl groups are preferred. When used, hydroxy functional monomers constitute from about 0.5 to 30, more preferably 1 to about 25 weight percent of the monomers used to formulate the copolymer, subject to preferred weight ranges for graft copolymers noted below.

Representative examples of suitable hydroxyl functional monomers include an ester of an α, β-unsaturated carboxylic acid with a diol, e.g., 2-hydroxyethyl (meth)acrylate, or 2-hydroxypropyl (meth)acrylate; 1,3-dihydroxypropyl-2-(meth)acrylate; 2,3-dihydroxypropyl-1-(meth)acrylate; an adduct of an α, β-unsaturated carboxylic acid with caprolactone; an alkanol vinyl ether such as 2-hydroxyethyl vinyl ether; 4-vinylbenzyl alcohol; allyl alcohol; p-methylol styrene; or the like.

Multifunctional free radically reactive materials may also used to enhance one or more properties of the resultant toner particles, including crosslink density, hardness, tackiness, mar resistance, or the like. Examples of such higher functional, monomers include ethylene glycol di(meth)acrylate, hexanediol di(meth)acrylate, triethylene glycol di(meth) acrylate, tetraethylene glycol di(meth)acrylate, trimethylolpropane tri(meth)acrylate, ethoxylated trimethylolpropane tri(meth)acrylate, glycerol tri(meth)acrylate, pentaerythritol tri(meth)acrylate, pentaerythritol tetra(meth)acrylate, and neopentyl glycol di(meth)acrylate, divinyl benzene, combinations of these, and the like.

Suitable free radically reactive oligomer and/or polymeric materials for use in the present invention include, but are not limited to, (meth)acrylated urethanes (i.e., urethane (meth) acrylates), (meth)acrylated epoxies (i.e., epoxy (meth)acrylates), (meth)acrylated polyesters (i.e., polyester (meth)acrylates), (meth)acrylated (meth)acrylics, (meth)acrylated silicones, (meth)acrylated polyethers (i.e., polyether (meth) acrylates), vinyl(meth)acrylates, and (meth)acrylated oils.

Copolymers of the present invention can be prepared by free-radical polymerization methods known in the art, including but not limited to bulk, solution, and dispersion polymerization methods. The resultant copolymers may have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S portion or D portion materials, as the case may be, may be incorporated into the arms and/or the backbone.

Any number of reactions known to those skilled in the art may be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K.E.J. Barrett, ed., (John Wiley; New York, 1975) pp. 79–106, also incorporated herein by reference.

Representative examples of grafting methods also may use an anchoring group. The function of the anchoring group is to provide a covalently bonded link between the core part of the copolymer (the D material) and the soluble shell component (the S material). Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone.

The preferred methodology described above accomplishes grafting via attaching an ethylenically-unsaturated isocyanate (e.g. dimethyl-m-isopropenyl benzylisocyanate, TMI, available from CYTEC Industries, West Paterson, N.J.; or isocyanatoethyl methacrylate, IEM) to hydroxyl groups in order to provide free radically reactive anchoring groups.

A preferred method of forming a graft copolymer of the present invention involves three reaction steps that are carried out in a suitable substantially nonaqueous liquid carrier in which resultant S material is soluble while D material is dispersed or insoluble.

In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. meta-isopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer. For instance, using the Hildebrand solubility parameters in Table 1, monomers such as e.g. methyl (meth)acrylate, ethyl (meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially nonaqueous liquid carrier for the organosol. At this stage, it is believed that the copolymer tends to exist in the liquid carrier as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the liquid carrier. It can be appreciated that the copolymer is thus advantageously formed in the liquid carrier in situ.

Before further processing, the copolymer particles may remain in the reaction solvent. Alternatively, the particles may be transferred in any suitable way into fresh solvent that is the same or different so long as the copolymer has solvated and dispersed phases in the fresh solvent. In either case, the resulting organosol is then converted into toner particles by mixing the organosol with at least one visual enhancement additive. Optionally, one or more other desired ingredients also can be mixed into the organosol before and/or after combination with the visual enhancement particles. During such combination, it is believed that ingredients comprising the visual enhancement additive and the copolymer will tend to self-assemble into composite particles having a structure wherein the dispersed phase portions generally tend to associate with the visual enhancement additive particles (for example, by physically and/or chemically interacting with the surface of the particles), while the solvated phase portions help promote dispersion in the carrier.

As noted above, the toner particles are positively charged. This charge is preferably provided by addition of one or more charge directors (also known as a charge control additive or "CCA"). The charge director can be included as a separate ingredient and/or included as one or more functional moiety(ies) of the binder polymer. The charge director acts to enhance the chargeability and/or impart a charge to the toner particles.

The charge director can be incorporated into the toner particles using a variety of methods, such as copolymerizing a suitable monomer with the other monomers used to form the copolymer, chemically reacting the charge director with the toner particle, chemically or physically adsorbing the charge director onto the toner particle (resin or pigment), or chelating the charge director to a functional group incorporated into the toner particle.

The charge director acts to impart an electrical charge of selected polarity onto the toner particles. Any number of charge directors described in the art can be used. For example, the charge director can be provided in the form of metal salts consisting of polyvalent metal ions and organic anions as the counterion. Suitable metal ions include, but are not limited to, Ba(II), Ca(II), Mn(II), Zn(II), Zr(IV), Cu(II), Al(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, lauric acid, tallic acid, and the like.

Preferred positive charge directors include metallic soaps, and particularly metallic carboxylates, for example, as described in U.S. Pat. No. 3,411,936 (incorporated herein by reference). Preferably, the metal of the metal soap is selected from zirconium, tin and titanium. A particularly preferred positive charge director is zirconium tetraoctoate (available as Zirconium HEX-CEM from OMG Chemical Company, Cleveland, Ohio).

The preferred charge director levels for a given toner formulation will depend upon a number of factors, including the composition of the polymeric binder, the pigment used in making the toner composition, and the ratio of binder to pigment. In addition, preferred charge director levels will depend upon the nature of the electrophotographic imaging process. The level of charge director can be adjusted based upon the parameters listed herein, as known in the art. The amount of the charge director, based on 100 parts by weight of the toner solids, is generally in the range of 0.01 to 10 parts by weight, preferably 0.1 to 5 parts by weight.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and is seen in the low relationship between current density and toner deposited during development. Low conductivities indicate little or no charging of the toner particles and lead to very low development rates. The use of charge directors matched to adsorption sites on the toner particles is a common practice to ensure sufficient charge associates with each toner particle.

Toner particles typically incorporate visual enhancement additives such as colorants (e.g pigments or dyes and combinations thereof), which are preferably present to render the latent image visible, though this need not be done in some applications. The colorant e.g., a pigment, may be present in the amount of up to about 60 percent by weight or more based on the weight of the resin. The amount of colorant may vary depending on the use of the developer. Examples of pigments are: Monastral™ Blue G (C.I. Pigment Blue 15 C.I. No. 74160), Toluidine Red Y (C.I. Pigment Red 3), Quindo™ Magenta (Pigment Red 122), Indo™ Brilliant Scarlet (Pigment Red 123 C.I. No. 71145), Toluidine Red B (C.I. Pigment Red 3). Watchung™ Red B (C.I. Pigment Red 48), Permanent Rubine F6B13-1731 (Pigment Red 184), Hansa™ Yellow (Pigment Yellow 98), Dalamar™ Yellow (Pigment Yellow 74, C.I. No. 11741), Toluidine Yellow G (C.I. Pigment Yellow 1), Monastral™ Blue B (C.I. Pigment Blue 15), Monastral™ Green B (C.I. Pigment Green 7), Pigment Scarlet (C.I. Pigment Red 60), Auric Brown (C.I. Pigment Brown 6), Monastral™ Green G (Pigment Green 7), Carbon Black, Cabot Mogul L (black Pigment C.I. No. 77266) and Sterling NS N 774 (Pigment Black 7, C.I. No. 77266).

Fine particle size oxides, e.g., silica, alumina, titania, etc.; preferably in the order of 0.5 mu.m or less can be dispersed into the liquefied resin. These oxides can be used alone or in combination with the colorants. Metal particles can also be added.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50 microns, more preferably in the range of about 3 to about 10 microns, most preferably in the range of about 1.5 to about 5 microns.

As noted above, in electrography, a latent image is typically formed by (1) placing a charge image onto the dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. Images formed by the present invention may be of a single color or a plurality of colors. Multicolor images can be prepared by repetition of the charging and toner application steps.

In electrophotography, the electrostatic image is typically formed on a drum or belt coated with a photoreceptive element by (1) uniformly charging the photoreceptive element with an applied voltage, (2) exposing and discharging portions of the photoreceptive element with a radiation source to form a latent image, (3) applying a toner to the latent image to form a toned image, and (4) transferring the toned image through one or more steps to a final receptor sheet. In some applications, it is sometimes desirable to fix the toned image using a heated pressure roller or other fixing methods known in the art.

These and other aspects of the present invention are demonstrated in the illustrative examples that follow.

EXAMPLES

Test Methods and Apparatus

In the following examples, percent solids of the copolymer solutions and the organosol and ink dispersions were determined gravimetrically using the Halogen Lamp Drying Method using a halogen lamp drying oven attachment to a precision analytical balance (Mettler Instruments, Inc., Highstown, N.J.). Approximately two grams of sample were used in each determination of percent solids using this sample dry down method.

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using tetrahydrofuran as the carrier solvent. Absolute weight average molecular weight were determined using a Dawn DSP-F light scattering detector (Wyatt Technology Corp., Santa Barbara, Calif.), while polydispersity was evaluated by ratioing the measured weight average molecular weight to a value of number average molecular weight determined with an Optilab 903 differential refractometer detector (Wyatt Technology Corp., Santa Barbara, Calif.).

Organosol and toner particle size distributions were determined by the Laser Diffraction Laser Diffraction Light Scattering Method using a Horiba LA-900 laser diffraction particle size analyzer (Horiba Instruments, Inc., Irvine, Calif.). Samples are diluted approximately 1/500 by volume and sonicated for one minute at 150 watts and 20 kHz prior to measurement. Particle size was expressed as both a number mean diameter ($D_n$) and a volume mean diameter ($D_v$) and in order to provide an indication of both the fundamental (primary) particle size and the presence of aggregates or agglomerates.

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 5° C. for 1–2 hours at 6,000 rpm (6,110 relative centrifugal force) in a Jouan MR1822 centrifuge (Winchester, Va.). The supernatant liquid was then carefully decanted, and the conductivity of this liquid was measured using a Scientifica Model 627 conductance meter. The percentage of free phase conductivity relative to the bulk toner conductivity was then determined as 100% ($k_f/k_b$).

The charge per mass measurement (Q/M) was measured using an apparatus that consists of a conductive metal plate, a glass plate coated with Indium Tin Oxide (ITO), a high voltage power supply, an electrometer, and a personal computer (PC) for data acquisition. A 1% solution of ink was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times a second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles may be made to migrate to that plate.

The ITO coated glass plate was removed from the apparatus and placed in an oven for approximately 30 minutes at 50° C. to dry the plated ink completely. After drying, the ITO coated glass plate containing the dried ink film was weighed. The ink was then removed from the ITO coated glass plate using a cloth wipe impregnated with Norpar™ 12, and the clean ITO glass plate was weighed again. The difference in mass between the dry ink coated glass plate and the clean glass plate is taken as the mass of ink particles (m) deposited during the 20 second plating time. The electrical current values were used to obtain the total charge carried by the toner particles (Q) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated ink mass.

Turning now to the Drawings, FIG. 1 shows the effect of the amount of an acid adjuvant (alkylbenzenesulfonic acid, ABSA) on the bulk conductivity of the depleted toner; the toner bulk conductivity decreased with the amount of the addition of ABSA in the depleted toner. Thus, toner conductivity can be maintained at a desirable and stable value by controlling the amount of the adjuvant in the toner.

It was noticed that the toner conductivity reached a minimum value at ABSA concentration of 1.0 (mg/g toner solution). Further investigation indicates that this minimum value corresponded to the CMC of ASBA in Norpar™12. The increase of the toner conductivity after CMC of ASBA was contributed to its micelle formation in Norpar™12. The CMC of ABSA in Norpar™12 was measured by dynamic light scattering techniques. The size of the micelles were measured against the concentration of ABSA in Norpar™12, below a concentration of 1.0 (mg/g toner solution), no micelle was detected, at and above the concentration of 1.0 (mg/g toner solution), ABSA formed micelles in the size range of 6 to 8 nm.

FIG. 2 shows the effect of the concentration of an acid adjuvant (ABSA) on a toner bulk conductivity on yellow, magenta, cyan and black ("YMCK") toners.

FIG. 3 shows the effect of the concentration of a base adjuvant (dodecylamine, DDA) on the toner bulk conductivity. The conductivity of the YMCK toners decreased with the increase of the DDA concentration. This indicates that DDA can be used to maintain the toner conductivity at a desirable value during the printing to achieve good and stable optical density of the images.

FIG. 4 and FIG. 5 show the effects of carbon chain length of various carboxylic acids on bulk conductivity of toner and Q/M value of the toner particles, respectively, indicating that increasing carbon chain length of a carboxylic acid increases the effect of the adjuvants.

FIG. 6 and FIG. 7 show the effects of carbon chain length of the amines on bulk conductivity of the toners and Q/M value of the toner particles, respectively, indicating the effectiveness of the adjuvants can also be varied by changing the carbon chain length of the amines.

Examples

Preparing Liquid Toner

Liquid toners used in this study were organosol based toners which were positively charged with zirconium tetraoctoate. The preparation of this type of liquid toners involves the synthesis of the organosol binder and milling of the organosol binder and pigments. The organosol synthesis involves graft stabilizer synthesis using solution polymerization and organosol synthesis using dispersion polymerization.

Materials used in the examples have the following abbreviations:

EA: ethyl acrylate

EHMA: 2-Ethylhexyl Methacrylate

MMA: Methyl Methacrylate

HEMA: 2-hydroxyethyl methacrylate
TMI: dimethyl-m-isopropenyl benzyl isocyanate
V-601: initiator, dimethyl 2,2'-azobisisobutyrate
DBTDL: catalyst, dibutyl tin dilaurate 1) Graft Stabilizer Synthesis A 5000 ml 3-neck round flask equipped with a condenser, a thermocouple connected to a digital temperature controller, a nitrogen inlet tube connected to a source of dry nitrogen and a magnetic stirrer, was charged with a mixture of 2557 g of Norpar™ 12, 849 g of EHMA, 26.8 g of 98% HEMA and 13.13 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative. The mixture was heated to 90° C. and held at that temperature for 1 hour to destroy any residual V-601 then was cooled back to 70° C. The nitrogen inlet tube was then removed, and 13.6 g of 95% DBTDL were added to the mixture, followed by 41.1 g of TMI. The TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/minute. The mixture was allowed to react at 70° C. for 6 hours, at which time the conversion was quantitative. The cooled mixture was viscous, transparent solution, containing no visible insoluble matter.

The percent solids of the liquid mixture was determined to be 24.72% using the Halogen Drying Method described above. Subsequent determination of molecular weight was made using the GPC method described above; the copolymer had a $M_w$ of 131,600 Da and $M_w/M_n$, of 2.3 based upon two independent measurements.

2) Organosol Synthesis

A 5000 ml 3-neck round flask equipped with a condenser, a thermocouple connected to a digital temperature controller, a nitrogen inlet tube connected to a source of dry nitrogen and a magnetic stirrer, was charged with a mixture of 2937 g of Norpar™ 12, 91.6 g of MMA, 91.6 g of EA, 188.8 g of the above graft stabilizer mixture at 24.72% polymer solids, and 4.20 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative. The mixture was cooled to room temperature, yielding an opaque white dispersion.

Approximately 350 g of n-heptane were added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was cooled to room temperature, yielding an opaque white dispersion.

The percent solids of the organosol dispersion after stripping was determined to be 14.60% using Halogen Drying Method described above. Subsequent determination of average particle size was made using the Laser Diffraction Analysis described above; the organosol had a volume average diameter of 0.24 μm.

3) Toner Formulation

Control 1

This is an example of preparing a yellow liquid toner at a weight ratio of organosol copolymer to pigment of 5 (O/P ratio). 205 g of the above organosol at 14.60% (w/w) solids in Norpar™ 12 was combined with 88 g of Norpar™ 12, 5.4 g of Pigment Yellow 138, and 0.6 g of Pigment Yellow 83 (Sun Chemical Company, Cincinnati, Ohio) and 0.79 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 1.0 micron
Bulk Conductivity: 984 picoMhos/cm
Percent Free Phase Conductivity: 3.8%
Dynamic Mobility: 2.28E-10 ($m^2$/Vsec)

This toner was further diluted to 3% and printed on an electrophotographic printer. After approximately 2000 to 3000 prints, the conductivity of the toner was too high to obtain proper optical density of the image.

Control 2

This is an example of preparing a magenta liquid toner at a weight ratio of organosol copolymer to pigment of 5 (O/P ratio). 205 g of the above organosol at 14.60% (w/w) solids in Norpar™ 12 was combined with 88 g of Norpar™ 12, 6 g of Pigment Red 81:4 (Magruder Color Company, Tucson, Ariz.) and 0.98 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 1.1 micron
Bulk Conductivity: 949 picoMhos/cm
Percent Free Phase Conductivity: 3.7%
Dynamic Mobility: 2.08E-11 ($m^2$/Vsec)

This toner was further diluted to 3% and printed on an electrophotographic printer. After approximately 2000 to 3000 prints, the conductivity of the toner was too high to obtain proper optical density of the image.

Control 3

This is an example of preparing a cyan liquid toner at a weight ratio of organosol copolymer to pigment of 8 (O/P ratio). 219 g of the above organosol at 14.60% (w/w) solids in Norpar™ 12 was combined with 88 g of Norpar™ 12, 4 g of Pigment Blue15:4 (PB:15:4, 249–3450, Sun Chemical Company, Cincinnati, Ohio) and 1.64 g of 6.11% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 1.5 micron
Bulk Conductivity: 406 picoMhos/cm
Percent Free Phase Conductivity: 1.4%
Dynamic Mobility: 1.56E-10 ($m^2$/Vsec)

This toner was further diluted to 3% and printed on an electrophotographic printer. After approximately 2000 to 3000 prints, the conductivity of the toner was too high to obtain proper optical density of the image.

Control 4

This is an example of preparing a black liquid toner at a weight ratio of organosol copolymer to pigment of 6 (O/P ratio). 211 g of the above organosol at 14.60% (w/w) solids in Norpar™ 12 was combined with 88 g of Norpar™ 12, 5 g of Cabot Monarch 120 Black 7.58 g of 6.11% Zirconium HEX-CEM solution (O(Cabot Corporation, Billerica, Mass.) and MG Chemical Company, Cleveland, Ohio) in an 8 ounce glass jar. This mixture was then milled in a 0.5 liter vertical bead mill (Model 6TSG-1/4, Amex Co., Led., Tokyo, Japan) and charged with 390 g of 1.3 mm diameter Potters glass beads (Potters Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 0.6 micron
Bulk Conductivity: 1052 picoMhos/cm
Percent Free Phase Conductivity: 4.3%
Dynamic Mobility: 3.2E-10 ($m^2$/Vsec)

This toner was further diluted to 3% and printed on an electrophotographic printer. After approximately 2000 to 3000 prints, the conductivity of the toner was too high to obtain proper optical density of the image.

Example 1

0.75 g of alkylbenzenesulfonic acid (ABSA, an alkyl benzene sulfonic acid that comprises a blend of C11, C12 and C13 carbon chain length alkyl portions) @ 10% Norpar™ 12 solution was added into 750 g of depleted toner from control 1. The solution was equilibrated for 1 hour. The conductivity of the toner was found to be dropped from 244 to 118 pMho/cm. The toner was poured back into the electrophotographic printer and good optical density of the image was achieved.

Example 2

0.75 g of alkylbenzenesulfonic acid @ 10% Norpar™ 12 solution was added into 750 g of depleted toner from control 2. The solution was equilibrated for 1 hour. The conductivity of the toner was found to be dropped from 349 to 108 pMho/cm. The toner was poured back into the electrophotographic printer and good optical density of the image was achieved.

Example 3

0.75 g of alkylbenzenesulfonic acid @ 10% Norpar™ 12 solution was added into 750 g of depleted toner from control 3. The solution was equilibrated for 1 hour. The conductivity of the toner was found to be dropped from 121 to 71 pMho/cm. The toner was poured back into the electrophotographic printer and good optical density of the image was achieved.

Example 4

1.875 g of alkylbenzenesulfonic acid @ 10% Norpar™ 12 solution was added into 750 g of depleted toner from control 4. The solution was equilibrated for 1 hour. The conductivity of the toner was found to be dropped from 398 to 251 pMho/cm. The toner was poured back into the electrophotographic printer and good optical density of the image was achieved.

Example 5

3.75 g of dodecylamine @ 10% Norpar™ 12 solution was added into 750 g of depleted toner from control 1. The solution was equilibrated for 1 hour. The conductivity of the toner was found to be dropped from 244 to 119 pMho/cm. The toner was poured back into the electrophotographic printer and good optical density of the image was achieved.

Example 6

7.5 g of dodecylamine @ 10% Norpar™ 12 solution was added into 750 g of depleted toner from control 2. The solution was equilibrated for 1 hour. The conductivity of the toner was found to be dropped from 349 to 200 pMho/cm. The toner was poured back into the electrophotographic printer and good optical density of the image was achieved.

Example 7

0.75 g of dodecylamine @ 10% Norpar™ 12 solution was added into 750 g of depleted toner from control 3. The solution was equilibrated for 1 hour. The conductivity of the toner was found to be dropped from 121 to 80 pMho/cm. The toner was poured back into the electrophotographic printer and good optical density of the image was achieved.

Example 8

0.75 g of dodecylamine @ 10% Norpar™ 12 solution was added into 750 g of depleted toner from control 4. The solution was equilibrated for 1 hour. The conductivity of the toner was found to be dropped from 398 to 241 pMho/cm. The toner was poured back into the electrophotographic printer and good optical density of the image was achieved.

| Toners | Adjuvant (mg/g toner solution) | Conductivity (pMh/cm) | OD |
|---|---|---|---|
| Control 1 | 0 | 244 | Low |
| Control 2 | 0 | 349 | Low |
| Control 3 | 0 | 121 | Low |
| Control 4 | 0 | 398 | Low |
| Example 1 | 0.1 (ABSA) | 118 | Good |
| Example 2 | 0.1 (ABSA) | 108 | Good |
| Example 3 | 0.1 (ABSA) | 71 | Good |
| Example 4 | 0.25 (ABSA) | 251 | Good |
| Example 5 | 0.5 (DDA) | 119 | Good |
| Example 6 | 1.0 (DDA) | 200 | Good |
| Example 7 | 0.1 (DDA) | 80 | Good |
| Example 8 | 0.1 (DDA) | 241 | Good |

Thus, toner compositions comprising charge control adjuvants as taught herein provide images exhibiting excellent optical density, in contrast with control toner compositions not containing the present charge control adjuvants.

All patents, patent documents, and publications cited herein are incorporated by reference as if individually incorporated. Unless otherwise indicated, all parts and percentages are by weight and all molecular weights are weight average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

The invention claimed is:

1. A positive liquid electrographic toner composition comprising:

a) a liquid carrier having a Kauri-Butanol number less than about 30 mL;

b) a plurality of positively charged toner particles dispersed in the liquid carrier, wherein the toner particles comprise a polymeric binder comprising at least one amphipathic graft copolymer comprising one or more S material portions and one or more D material portions; and c) a charge control adjuvant that is an acid or a base added as an ingredient separate from the toner particles and present in an amount effective to reduce the bulk conductivity of the liquid toner composition as the positively charged toner particles are depleted during printing operations;

wherein the charge control adjuvant is present in the toner composition in an amount higher than the solubility of the charge control adjuvant in the liquid carrier.

2. The toner composition of claim 1, wherein the charge control adjuvant comprises a base selected from primary amines, secondary amines and tertiary amines.

3. The toner composition of claim 1, wherein the charge control adjuvant comprises a base selected from the group consisting of alkyl amines and amino-functional polymers.

4. The toner composition of claim 1, wherein the charge control adjuvant comprises a base selected from alkyl amines having 12 to 18 carbon atoms in the alkyl portions of the alkyl group.

5. The toner composition of claim 1, wherein the charge control adjuvant comprises a base selected from hexylamine, octylamine, dodecylamine, tetradecylamine, hexadecylamine, octadecylamine and mixtures thereof.

6. The toner composition of claim 1, wherein the charge control adjuvant comprises an acid selected from sulfonic acids and carboxylic acids.

7. The toner composition of claim 1, wherein the charge control adjuvant comprises an acid selected from alkyl benzene sulfonic acids, alkyl carboxylic acids and acid functional polymers.

8. The toner composition of claim 1, wherein the charge control adjuvant comprises an acid selected from alkyl benzene sulfonic acids and alkyl carboxylic acids having 12 to 18 carbon atoms in the alkyl portions of the alkyl group.

9. The toner composition of claim 1, wherein the charge control adjuvant comprises an acid selected from hexanoic acid, octanoic acid, dodecanoic acid, tetradecanoic acid, hexadecanoic acid, octadecanoic acid, hexyl benzene sulfonic acid, octyl benzene sulfonic acid, dodecyl benzene sulfonic acid, tetradecyl benzene sulfonic acid, hexadecyl benzene sulfonic acid, octadecyl benzene sulfonic acid and mixtures thereof.

10. The toner composition of claim 1, wherein the charge control adjuvant is capable of forming micelles in the liquid carrier.

11. The toner composition of claim 10, wherein the charge control adjuvant is the present in the composition in the form of micelles having a size range of from about 5 to about 50 nm.

12. The toner composition of claim 1, wherein the charge control adjuvant has a solubility of about 0.1 to about 10 mg/g in the liquid carrier.

13. The toner composition of claim 1, wherein the charge control adjuvant is present in the toner composition at a concentration of from about 0.5 mg/g to about 5 mg/g in the liquid carrier.

14. The toner composition of claim 1, wherein the positively charged toner particles comprise a charge director component selected from metal soaps.

15. The toner composition of claim 1, wherein the positively charged toner particles comprise a charge director component selected from metal carboxylates.

16. The toner composition of claim 14, wherein the metal of the metal soap is selected from zirconium, tin and titanium.

17. The toner composition of claim 1, wherein the positively charged toner particles comprise at least one visual enhancement additive.

18. The toner composition of claim 17, wherein the one visual enhancement additive is a pigment.

19. The toner composition of claim 1, wherein the binder has a $T_g$ greater than about 30° C.

20. The toner composition of claim 1, wherein the binder has a $T_g$ less than about 30° C.

* * * * *